US006935323B2

(12) United States Patent
Waters et al.

(10) Patent No.: US 6,935,323 B2
(45) Date of Patent: Aug. 30, 2005

(54) LOW CURRENT EXTENDED DURATION SPARK IGNITION SYSTEM

(75) Inventors: Stephen Howard Waters, Normal, IL (US); Anthony Kok-Fai Chan, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 216 days.

(21) Appl. No.: 10/609,565

(22) Filed: Jul. 1, 2003

(65) Prior Publication Data

US 2005/0000502 A1 Jan. 6, 2005

(51) Int. Cl.[7] ..... F02P 3/12
(52) U.S. Cl. ..... 123/650; 123/651; 123/594
(58) Field of Search ..... 123/650, 651, 123/594, 606, 607, 406.12

(56) References Cited

U.S. PATENT DOCUMENTS 3,892,219 A 7/1975 Preiser et al.
3,919,993 A 11/1975 Neuman
3,938,490 A * 2/1976 Snyder et al. ..... 123/611
4,208,992 A * 6/1980 Polo ..... 123/406.51
4,345,575 A 8/1982 Jorgensen
5,221,904 A 6/1993 Shimasaki et al.
5,237,280 A 8/1993 Arnold et al.
5,619,959 A 4/1997 Tozzi
5,907,243 A 5/1999 Göras et al.
6,043,660 A 3/2000 Bahr et al.

* cited by examiner

*Primary Examiner*—Bibhu Mohanty
(74) *Attorney, Agent, or Firm*—Finnegan, Henderson, Farabow, Garrett & Dunner

(57) ABSTRACT

A system for firing a spark plug is disclosed. The system includes a timing controller configured to send a first timing signal and a second timing signal. The system also includes an ignition transformer having a primary winding and a secondary winding and a spark-plug that is operably associated with the secondary winding. A first switching element is disposed between the timing controller and the primary winding of the ignition transformer. The first switching element controls a supply of power to the primary winding based on the first timing signal. Also, a second switching element is disposed between the timing controller and the primary winding of the ignition transformer. The second switching element controls the supply of power to the primary winding based on the second timing signal. A method for firing a spark plug is also disclosed.

23 Claims, 4 Drawing Sheets

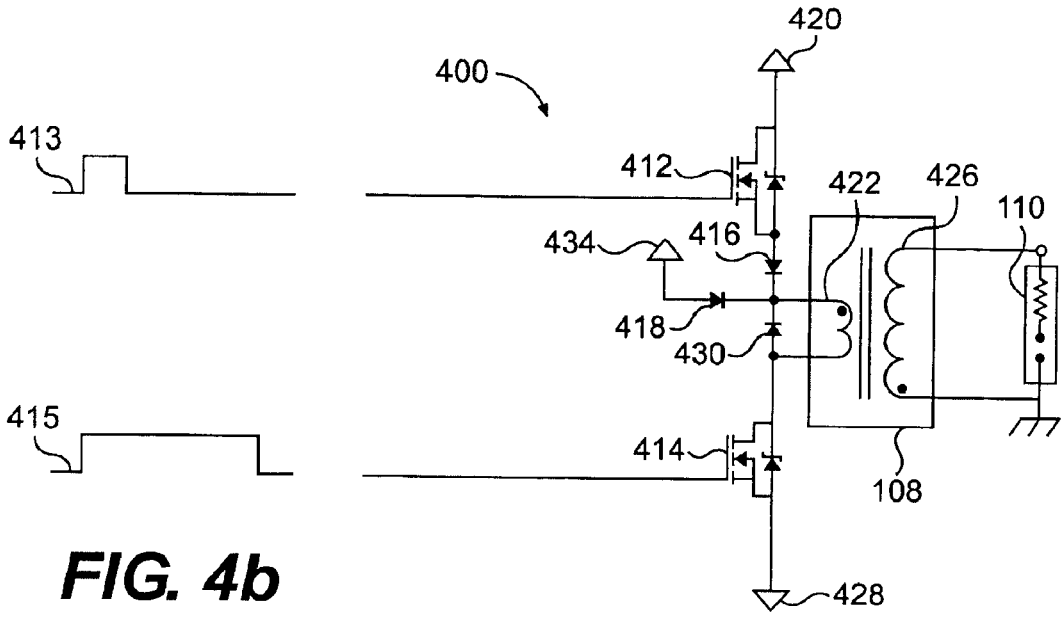
FIG. 4b
FIG. 4a
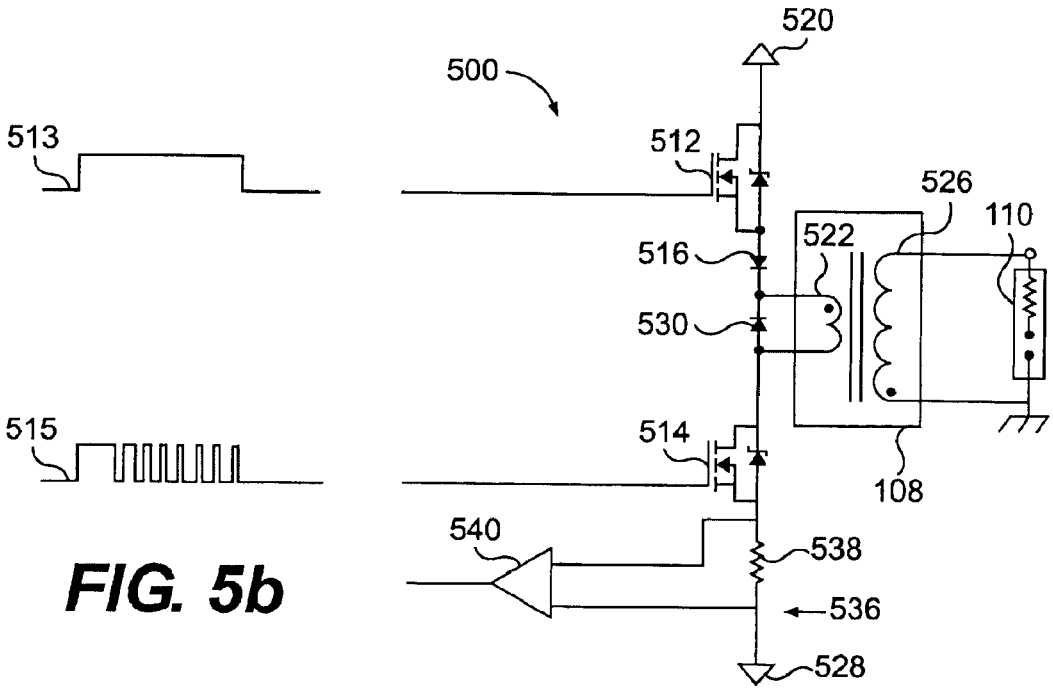
FIG. 5b
FIG. 5a

LOW CURRENT EXTENDED DURATION SPARK IGNITION SYSTEM

This invention was made with Government support under DOE Contract No. DE-AC36-83CH10093 awarded by the U.S. Department of Energy. Accordingly, the Government may have certain rights to this invention.

TECHNICAL FIELD

This invention relates to a spark ignited engine and, more particularly, to an ignition system for a spark ignited engine.

BACKGROUND

The life of a spark plug in an internal combustion engine may be affected by the magnitude of electrical current repeatedly passed across a gap in the spark plug to initiate sparks. High electrical currents may cause relatively fast erosion of the plug at the spark plug gap, thereby requiring frequent servicing of the engine to replace the spark plug. Low electrical currents, on the other hand, may not initiate a spark with sufficient intensity to fully and completely ignite a fuel within a combustion chamber of the engine.

Government regulations are increasingly requiring the use of alternative fuels to reduce pollution and emissions. Many of these alternative fuels may only be ignited with a spark having a higher intensity than the spark used to ignite traditional fuels. Accordingly, an engine designed to burn these types of alternative fuels may require an ignition system capable of generating a high intensity spark and, in some cases, an ignition system capable of sustaining a spark for an extended duration.

One example of a system for initiating and sustaining a spark across the gap of a spark plug is disclosed in U.S. Pat. No. 4,345,575 to Jorgensen. The '575 patent discloses an extended duration spark ignition system that has two power sources, a initiation switch, and a sustaining switch. The system includes a series of circuit components on both a primary side and a secondary side of an ignition transformer. The initiation and sustaining switches are on opposite sides of the ignition transformer. Accordingly, the secondary side of the circuit may be more complex than necessary and may include duplicate components, thereby increasing the overall cost of the circuit.

The present invention overcomes one or more of the disadvantages of the prior art.

SUMMARY OF THE INVENTION

In a first aspect, a system for firing a spark plug is disclosed. The system includes a timing controller configured to send a first timing signal and a second timing signal. The system also includes an ignition transformer having a primary winding and a secondary winding and a spark-plug that is operably associated with the secondary winding. A first switching element is disposed between the timing controller and the primary winding of the ignition transformer. The first switching element controls a supply of power to the primary winding based on the first timing signal. Also, a second switching element is disposed between the timing controller and the primary winding of the ignition transformer. The second switching element controls the supply of power to the primary winding based on the second timing signal.

In another aspect, a method for firing a spark plug is disclosed. The method includes operating a timing controller to generate a first timing signal and a second timing signal.

A first switching element is switched in response to the first timing signal to apply a first voltage to a primary winding of an ignition transformer. A second switching element is switched in response to the second timing signal to apply a second voltage to the primary winding of the ignition transformer. The first voltage applied to the primary winding is transformed to a third voltage across a spark-plug to initiate a spark. The second voltage applied to the primary winding may be transformed to a fourth voltage across the spark-plug to sustain the spark.

BRIEF DESCRIPTION OF THE DRAWINGS

FIG. 4*a* is a schematic diagram of another exemplary circuit.

FIG. 4*b* is a diagram of an exemplary waveform showing the relative timing of opening and closing of switching elements for the circuit of FIG. 4*a*.

FIG. 5*a* is a schematic diagram of another exemplary circuit.

FIG. 5*b* is a diagram of an exemplary waveform showing the relative timing of opening and closing of switching elements for the circuit of FIG. 5*a*.

DETAILED DESCRIPTION

Wherever possible, the last two digits of each reference number will be used throughout the drawings to refer to the same or like parts. Accordingly, it should be understood that the description of certain components with relation to one exemplary embodiment also applies to the same or like parts included in another exemplary embodiment.

Figure 1:
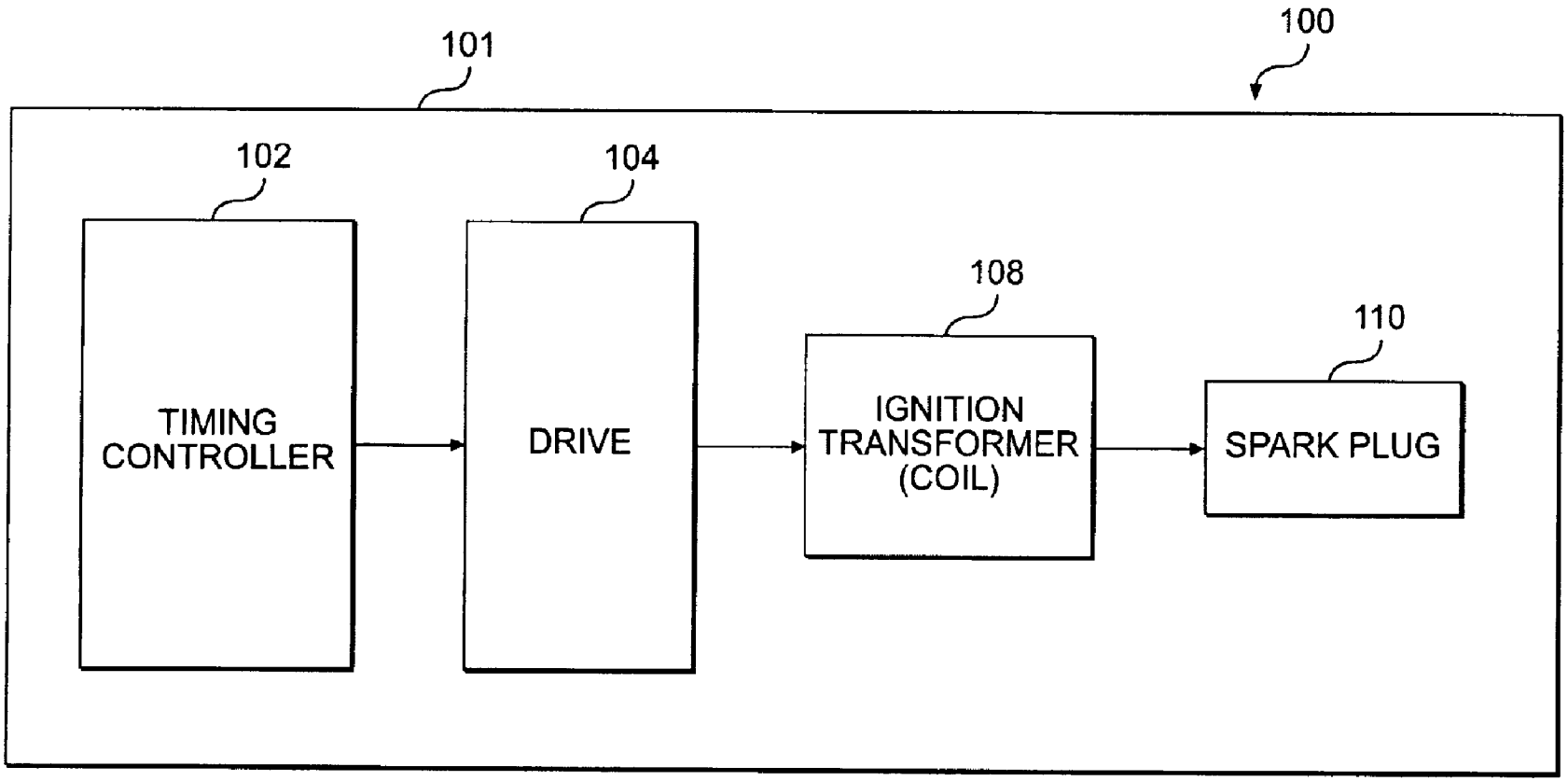
FIG. 1 is a block diagram of an exemplary embodiment of an ignition system.

FIG. 1 is a block diagram of a system 100 for firing a spark plug 110 associated with an engine 101. The system 100 may include a timing controller 102, a drive 104, and an ignition transformer 108. As described in greater detail below, the system 100 is operable to control the intensity and duration of a spark initiated by spark plug 110.

The spark plug 110 may be any known spark plug that forces a current to arc across a gap. It may also include an electrode at the gap, along with a ceramic insert that ensures that the spark occurs at the electrode tip. The spark plug 110 may require a high voltage to initiate a spark, such as, for example, voltage in the range of 40,000 to 100,000 volts. In one exemplary embodiment, the spark plug 110 includes internal noise suppression impedance.

The timing controller 102 could be any known controller, and may be associated with an engine control module associated with the engine 101. Also, the timing controller 102 may be configured to provide frequency and overlap/ delay adjustments to send a timing signal as a command signal to the drive 104. The timing controller 102 may be adapted to send signals based on the position of a rotating cam shaft, as is known in the art.

The drive 104 may be, for example, a DC drive operably associated with the timing controller 102. The drive 104 may include a power source and a switching element. It should be noted that drive 104 may include more than one switching element. Further, the drive 104 may be a DC drive, an AC drive, a chopped DC drive, or any other type of drive readily apparent to one skilled in the art. The power source for the drive 104 may be a battery, an alternator and/or generator associated with the engine 101, a shore power source, or other power source, as would be apparent to one skilled in the art.

In one exemplary embodiment, the system 100 may also include a second drive (not shown) that is operably associated with the timing controller 102. Like the first drive 104, the second drive may be a DC, an AC, or a chopped DC drive. In one exemplary embodiment, the first drive 104 is a DC, an AC, or a chopped DC drive, and the second drive is an AC or chopped DC drive. Other types and combinations of drive types could be used.

The ignition transformer 108 may be any known transformer and may include a primary and a secondary winding. In one exemplary embodiment, the transformer is an autotransformer, with the common winding serving as the primary winding and the series winding serving as the secondary winding. As described in greater detail below and as illustrated in FIGS. 2*a*, 3*a*, 4*a*, and 5*a*, the primary winding may be associated with the drive 104 through an electrical circuit. The ignition transformer 108 may be adapted to receive voltage from the drive 104, along with voltage from any other drive associated with the system 100. The secondary winding of the ignition transformer 108 may be connected to the spark plug 110, and may be operable to conduct electrical voltage from the transformer to the spark plug 110 to generate a spark for igniting a fuel.

In use, the timing controller 102 generates and sends a timing signal to operate the switching element (not shown) in the drive 104. In response, the drive 104 applies a voltage pulse of a set voltage and duration to the primary winding of the ignition transformer 108. The ignition transformer 108 transforms the voltage and generates an initial spark at the spark plug 110. The timing controller 102 may generate and send a second timing signal to a second switching element of the drive 104, or an alternate drive, to send a voltage pulse or a series of voltage pulses of a set voltage and duration to the primary winding of the ignition transformer 108, which transforms the voltage. This transformed voltage may be used to sustain the spark at the spark plug 110.

Figures 2A, 2B:
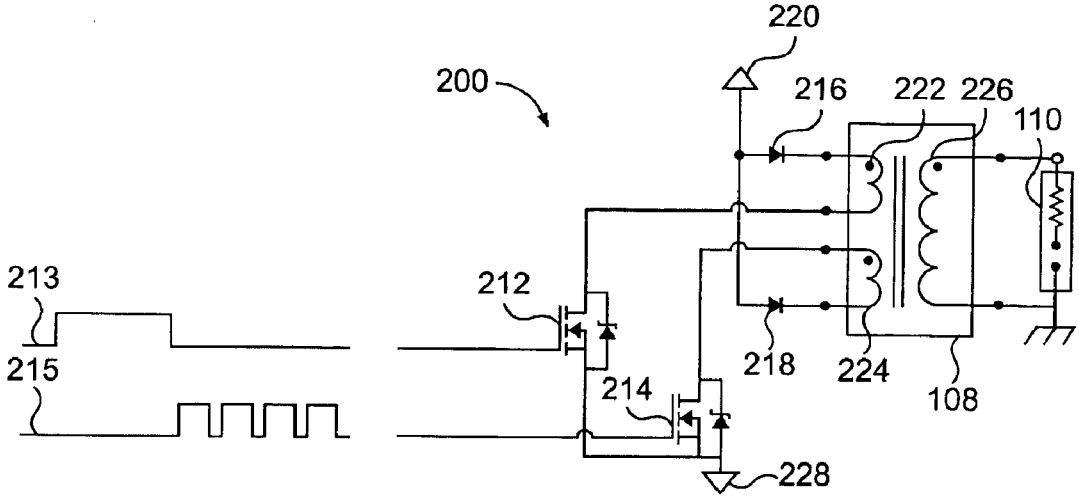
FIG. 2*a* is a schematic diagram of an exemplary circuit.
FIG. 2*b* is a diagram of an exemplary waveform showing the relative timing of opening and closing of switching elements for the circuit of FIG. 2*a*.

FIG. 2*a* is a schematic diagram showing a circuit 200 that connects the drive 104 (referring to FIG. 1) with the ignition transformer 108 and the spark plug 110. The circuit 200 may utilize low voltage from, for example, a battery, to provide power throughout an ignition firing cycle.

The circuit 200 may include switching elements 212, 214, steering/blocking diodes 216, 218, a power source 220, the ignition transformer 108, and the spark plug 110. In this embodiment, the drive 104 may be comprised of the power source 220 and the switching elements 212, 214. The switching elements 212, 214 may be in electrical communication with the timing controller 102 of FIG. 1. The timing controller 102 may send the first and second timing signals to the switching elements 212, 214 to open and close the switching elements 212, 214. In one exemplary embodiment, the switching elements 212, 214 are MOSFET transistors. In another exemplary embodiment, the switching elements 212, 214 are insulated gate bi-polar transistors. The switching elements could be other conventional transistors or switches known in the art. The power source 220 is connected to the ignition transformer 108 through the steering/blocking diodes 216, 218. The steering/blocking diodes 216, 218 could be any steering/blocking diode known in the art.

The ignition transformer 108 may have a first primary winding 222, a second primary winding 224, and a secondary winding 226. Each of the primary windings 222, 224 may consist of relatively few turns of heavy wire. The secondary winding 226 may consist of relatively many turns of thin wire wound concentrically on a magnetic core.

A current may be directed through the first and second primary windings 222 and 224 to generate a voltage across the secondary winding 226. The first primary winding 222 may be connected to the power source 220 in a manner such that a current flowing through the first primary winding 222 produces a voltage of positive polarity across the secondary winding 226, and subsequently the spark plug 110. The second primary winding 224 may be connected to the power source 220 in a manner such that a current flowing through the second primary winding 222 produces a voltage of negative polarity across the secondary winding 226, and subsequently the spark plug 110.

An electrical current flows in the first primary winding 222 when the timing controller 102 sends a timing signal to set the first switching element 212 to a closed condition. Similarly, an electrical current flows in the second primary winding 224 when the timing controller 102 sends a timing signal to set the second switching element 214 to a closed condition. A current return path 228 completes the circuit, connecting to the negative side of the power source 220.

FIG. 2*b* shows a first waveform 213 and a second waveform 215 that represent timing signals from the timing controller 102 to the switching elements 212, 214 as functions of time for one ignition firing cycle. The first waveform 213 represents a timing signal for the first switching element 212 and the second waveform 215 represents a timing signal for the second switching element 214. When the shape of the waveform is high, the switch is closed, and when the waveform is low, the switch is open. According to the first waveform 213, the first switching element 212 is closed by the timing controller 102 for a period of time, and then opened. The second switching element 214 is closed when the first switching element 212 is opened, and then intermittently opened and closed for brief intervals. When both waveforms become flat, the ignition firing cycle is complete. Further operation of the circuit 200 is discussed further below with reference to FIG. 6.

Figures 3A, 3B:
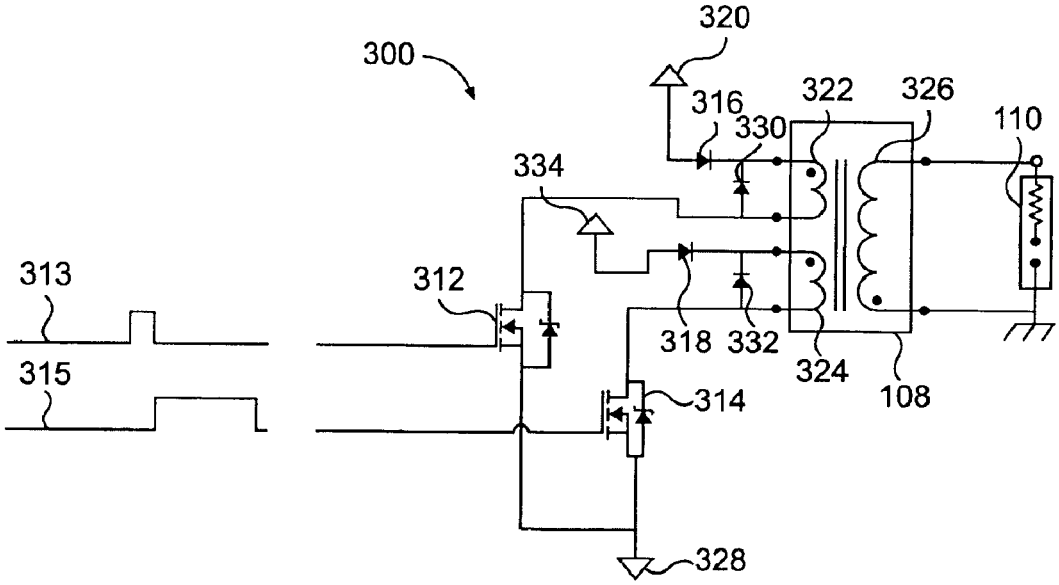
FIG. 3*a* is a schematic diagram of another exemplary circuit.
FIG. 3*b* is a diagram of an exemplary waveform showing the relative timing of opening and closing of switching elements for the circuit of FIG. 3*a*.

FIG. 3*a* shows another exemplary circuit 300 for initiating and sustaining a spark. The circuit 300 includes switching elements 312, 314, steering/blocking diodes 316, 318, and discharge diodes 330, 332. Additionally, the circuit 300 includes a first power source 320, a second power source 334, the ignition transformer 108, and the spark plug 110.

The circuit 300 of FIG. 3*a* is similar to the circuit 200 of FIG. 2*a* in that the switching elements 312, 314 are each in electrical communication with the timing controller 102 of FIG. 1, and receive first and second timing signals. The switching elements 312, 314 open and close as controlled by the timing signals from the timing controller 102. The circuit 300, however, differs from the circuit 200 in that two power sources are provided. In this embodiment, the first power source 320 is a relatively high power source for initiation of a spark at the spark plug 110, and the second power source 334 is a relatively low power source for sustaining the spark during the ignition firing cycle. In one exemplary embodiment, the first power source 320 may be an alternator and/or generator, and the second power source 334 may be a battery source.

As in the embodiment of FIG. 2*a*, the ignition transformer 108 includes first and second primary windings 322, 324 and a secondary winding 326. The first primary winding 322 may be electrically connected to the first power source 320 through the first steering/blocking diode 316. Likewise, the second primary winding 324 may be connected to the second power source 334 through the second steering/blocking diode 318. The primary windings 322, 324 may be connected to their respective power sources in such a way that the current flowing through first and second primary windings 322, 324 produces a voltage of negative polarity across the secondary winding 326 and subsequently the spark plug 110. The first discharge diode 330 joins the positive side and negative side of the first primary winding 322 to allow the discharge of stored power from the first primary winding 322. Likewise, the second discharge diode 332 joins the positive side and negative side of the second primary winding 324 to allow the discharge of stored power from the second primary winding 324.

When the first switching element 312 is closed, current flows in the first primary winding 322. Similarly, when the second switching element 314 is closed, current flows in the second primary winding 324. As stated above, the switching elements 312, 314 are controlled by timing signals from the timing controller 102. A current return path 328 completes the circuit, connecting to the negative side of the power source (not shown).

FIG. 3*b* shows a first waveform 313 and a second waveform 315 that represent timing signal commands as functions of time from the timing controller 102. According to the first waveform 313, the first switching element 312 is closed by the timing controller 102 for a moderately short period of time, and then opened. The second switching element 314 is closed at substantially the same time that the first switching element 312 is opened, and then held open for a relatively longer period of time. When both waveforms 313, 315 become flat, the ignition firing cycle is complete.

FIG. 4*a* shows another exemplary circuit 400 for initiating and sustaining a spark. A single primary winding 422 is used for both the initial spark generation and the sustain portion of the ignition firing cycle. The circuit 400 includes first and second switching elements 412, 414, first and second steering/blocking diodes 416, 418, and a discharge diode 430. Additionally, the circuit 400 may include a first power source 420, a second power source 434, the ignition transformer 108, and the spark plug 110.

In the exemplary circuit 400 of FIG. 4*a*, the first and second switching elements 412, 414 may be operably associated with the timing controller 102 to receive timing signals from the timing controller 102 to switch between an open and a closed condition. The ignition transformer 108 includes the single primary winding 422 and a secondary winding 426. The primary winding 422 may be connected to both the first power source 420 and the second power source 434. In one exemplary embodiment, the first power source 420 may be a relatively higher voltage power source, and the second power source 434 may be a relatively lower voltage power source.

The first power source 420 may be electrically connected to the primary winding 422 through the first switching element 412 and the first steering/blocking diode 416. The second power source 434 may be connected to the primary winding 422 through only the second steering/blocking diode 418. In one exemplary embodiment, the primary winding 422 may be connected to the power sources 420, 434 in such a way that the current flowing through the primary winding 422 produces a voltage of negative polarity across the secondary winding 426, and subsequently the spark plug 110. The discharge diode 430 may join the positive side and negative side of the primary winding 422 to allow the discharge of stored power from the primary winding 422. The second switching element 414 may be disposed along a current return path 428 at the negative side of the primary winding 422.

FIG. 4*b* shows a first waveform 413 and a second waveform 415 that represent relative timing signal commands from the timing controller 102. The first and second waveforms 413, 415 show that the switching elements 412, 414 are substantially simultaneously closed by the timing controller 102. After a relatively short period of time, the first switching element 412 is opened, while the second switching element 414 is maintained closed. After a period of time, the second switching element 414 is opened, thereby completing the ignition firing cycle.

Current from the first power source 420 flows in the primary winding 422 when both switching elements 412, 414 are set at a closed condition. Under these circumstances, the second steering/blocking diode 418 may be reverse biased, obstructing current from the second power source 434 to the primary winding 422. Current from the second power source 434 may flow in the primary winding 422 by setting the second switching element 414 to a closed condition, while the first switching element 412 is set to an open condition.

FIG. 5*a* shows another exemplary circuit 500. The circuit 500 includes a single primary winding 522 and a single power source 520. The circuit includes first and second switching elements 512, 514, a steering/blocking diode 516, and a discharge diode 530. Additionally, the circuit 500 includes the power source 520, the ignition transformer 108, and the spark plug 110. The circuit 500 is a closed loop control system having a current return system 536 with a current measurement device 538 and a measurement and feedback controller 540 in communication with the timing controller 102. The current measurement device may be, for example, a resistor, a hall effect sensor, a current transformer, or another known measurement device.

In the exemplary circuit 500, the first and second switching elements 512, 514 may be operably associated with the timing controller 102 to receive timing signals from the timing controller 102 to switch between an open and closed condition. The ignition transformer 108 may include the primary winding 522 and a secondary winding 526. Through the first switching element 512 and the steering/blocking diode 516, the power source 520 may be electrically connected to the primary winding 522. The primary winding 522 is connected to the power source 520 so that the current flowing through the primary winding 522 produces a voltage of negative polarity across the secondary winding 526 and subsequently the spark plug 110. The discharge diode 530 may join the positive side and negative side of the primary winding 522 to allow the discharge of stored power from the primary winding 522. The second switching element 514 may be disposed in the circuit 500 at the negative side of the primary winding 522, along a current return path 528. The current return system 536 is disposed after the second switching element 514 in the circuit 500. The current return system 536 communicates with the timing controller 102 to control the current flow to the ignition transformer 108 to that which is needed to produce the intended ignition firing cycle.

FIG. 5*a* shows first waveform 513 and second waveform 515 representing relative timing signal commands from the timing controller 102. According to the first and second waveforms 513, 515, both switching elements 512, 514 are substantially simultaneously closed by the timing controller 102. After a relatively short period of time, the second switching element 514 is opened, while the first switching element 512 is maintained closed. The second switching element 514 is intermittently opened and closed, while the first switching element 512 maintains its closed condition. At or around the same time, both the switching elements 512, 514 are opened, as indicated by the waveforms 513, 515, thereby completing the ignition firing cycle.

Current flows from the voltage power source 520 in the primary winding 522 when both switching elements 512, 514 are set at a closed condition. The current flows at reduced effective levels in the primary winding 522 by rapidly switching either the first switching element 512 or the second switching element 514 between an open and closed condition. The rate of switching and duration of closed time proportionally controls the effective voltage across and current flowing through the primary winding 522. This allows significantly more flexibility in output voltage waveform.

Figure 6:
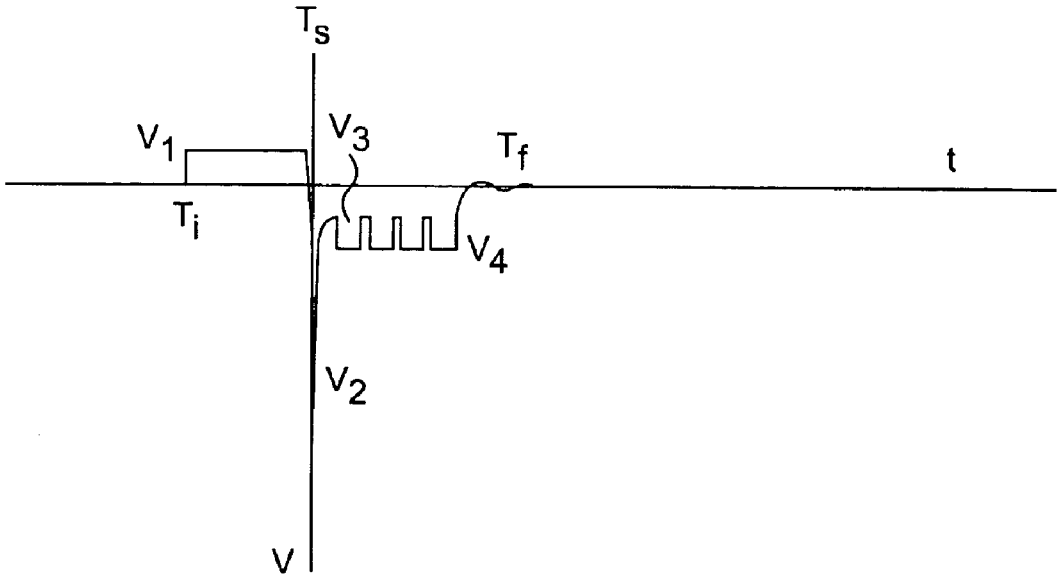
FIG. 6 is a graph depicting a voltage across a spark plug as a function of time for the circuit illustrated in FIG. 2*a*.
Figure 7:
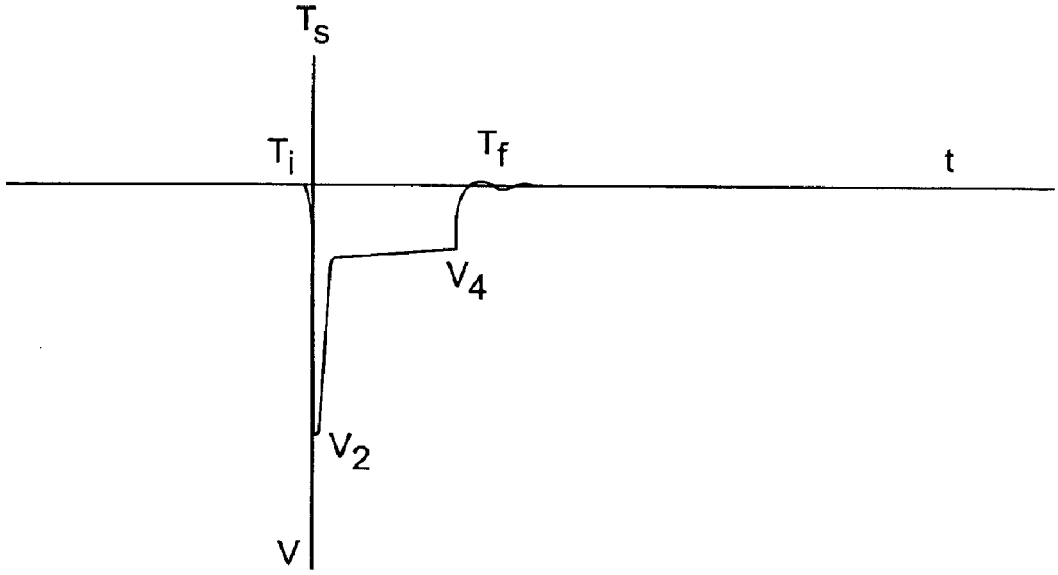
FIG. 7 is a graph depicting a voltage across a spark plug as a function of time for the circuits illustrated in FIGS. 3*a*, 4*a*, and 5*a*.

FIGS. 6 and 7 are graphs showing voltage as a function of time across the spark plug 110. FIG. 6 shows the voltage across the spark plug 110 for the circuit 200, while FIG. 7 shows the voltage across the spark plug 110 for the circuits 300, 400, and 500. In both FIGS. 6 and 7, the ignition firing cycle is initiated by the timing controller 102 at an initiation time Ti. The spark plug 110 discharges with a spark at a spark time Ts. At a finish time Tf, voltage is no longer supplied to the spark plug 110.

Industrial Applicability

The following discussion describes the operation of the above-described system during an exemplary ignition cycle. With reference to FIG. 6 and the circuit 200, at the initiation time Ti, the timing controller 102 sends a timing signal to the first switching element 212 to set it to a closed condition. The voltage across the secondary winding 226 and subsequently the spark plug 110 rises to $V_1$, as shown in FIG. 6. $V_1$ is approximately equal to the value of the voltage of the power source 220, less the sum of the voltage drop across the steering/blocking diode 216 and the first switching element 212, multiplied by the ratio of the number of turns of the secondary winding 226 to the number of turns of the first primary winding 222, as expressed in the following equation:

$$V_1 = (V_{source} - (V_{diode1} - V_{switch1})) * \frac{N_{secondary}}{N_{primary1}}$$

During the time interval from Ti to Ts, the ignition transformer 108 acts as an inductor, storing energy in the magnetic core. The current flow in the first primary winding 222 increases with time according to the equation:

$$I = \left(\frac{(V_{source} - V_{diode})}{R_{primary} + R_{switch}}\right) * 1 - e^{\left(\left(\frac{(R_{primary} + R_{switch})}{L_{primary}}\right) * T\right)}$$

The energy stored is equal to one half the inductance value multiplied by the square of the value of the current at time T, as expressed in the following equation:

$$E = \frac{1}{2} L_{primary} I^2$$

The initiation time Ti is chosen in advance of the desired spark time Ts, based upon the length of time required to provide a sufficient spark discharge in the gap of the spark plug 110. This requires storing sufficient energy in the magnetic core. Sufficient energy is the amount of energy that provides a good spark and provides some excess energy to be utilized during the sustain portion of the ignition firing cycle.

Again referring to FIGS. 1 and 6, just before spark time Ts, the timing controller 102 sets first switching element 212 to the open condition. Current ceases to flow in the first primary winding 222. Accordingly, the magnetic field in the magnetic core of the ignition transformer 108 collapses, releasing the stored voltage from the secondary winding 226. The voltage causes the spark plug 110 to change polarity and increase in potential until it reaches sufficiently high potential V2 to cause a spark across the gap of the spark plug 110. Once the initial spark has occurred, ionization in the gap provides a path for continued discharge, and the voltage across the secondary winding 226 drops to a level V3 that is sufficient to sustain current flow as a sustained spark across the gap. At this time, the timing controller 102 sets the second switching element 214 to the closed condition. The voltage across the secondary winding 226, and subsequently the spark plug 110, increases in potential by an amount equal to:

$$V = (V_{source} - (V_{diode2} - V_{switch2})) * \frac{N_{secondary}}{N_{primary2}}$$

The voltage increase is superimposed on the voltage level V3, resulting in a total voltage V4 which is greater than V3, enabling the energy of the core to continue to discharge through the spark gap. After a desired length of time, the timing controller 102 sets the second switching element 214 to the open condition, allowing the voltage across the secondary winding 226, and subsequently the spark plug 110, to decay briefly to voltage level V3 and a lower current. The timing controller 102 may repeat the process, setting the second switching element 214 to the closed condition, and then to the open condition, as desired, until all of the remaining stored energy has discharged from the magnetic core of the ignition transformer 108, and the end of the ignition firing cycle, Tf is reached.

With reference to FIG. 7, an ignition firing cycle for the circuit 300 is initiated by the timing controller 102. As described with reference to FIG. 6, the initiation time Ti is chosen in advance of the desired spark time Ts, based upon the length of time required to provide a sufficient spark discharge in the gap of the spark plug 110. At the initiation time Ti, the timing controller 102 sets the first switching element 312 to the closed condition. The voltage across the secondary winding 326, and subsequently the spark plug 110, increases in potential until it reaches a sufficiently high potential (V2 ) to cause a spark across the gap of the spark plug 110. At spark time Ts, the voltage begins to drop because of the increased loading on the secondary winding 326 presented by the arcing of the spark plug 110. While the voltage is dropping, but before it gets so low that the arc is interrupted, the timing controller 102 sets the first switching element 312 to an open condition, and sets the second switching element 314 to the closed condition, forcing voltage from the second power source 334 through the second primary winding 324. This drives the voltage across the secondary winding 326 and subsequently the spark plug 110, at a voltage V4, thereby ensuring that the discharge through the spark gap continues. At time Tf, the timing controller 102 sets the second switching element 314 the open condition, ending the ignition firing cycle. In one exemplary embodiment, the first power source 320 is a high voltage power source and the second power source 334 is a low voltage power source.

The ignition firing cycle for the circuit 400 may, like circuit 300, be described with reference to FIG. 7. However, in this embodiment of circuit 400, the timing controller 102 sets both the switching elements 412, 414 to the open condition at time Ti. The second steering/blocking diode 418 blocks current flow from the second power source 434 when both switching elements 412, 414 are closed. At spark time Ts, a spark is generated. Accordingly, at time Ts the voltage begins to drop. While the voltage is dropping, the timing controller 102 signals the first switching element 412 to switch to an open condition, while leaving second switching element 414 at the closed condition. Accordingly, the second steering/blocking diode 418 allows current from the power supply 434 to flow through the primary winding 422, driving the voltage across the secondary winding 226 and the spark plug 110. A voltage V4 is sufficiently high to ensure that the discharge through the spark gap will continue. At time Tf, the end of the ignition firing cycle, the timing controller 102 sets second switching element 414 to the open condition.

The ignition firing cycle for the circuit 500 may also be described with reference to FIG. 7. At initiation time Ti, the timing controller 102 sets both switching elements 512, 514 to the open condition. At spark time Ts, a spark is generated across the gap of the spark plug 110. While the voltage is dropping, the timing controller 102 signals the second switching element 514 to rapidly switch open and closed, while maintaining first switching element 512 in a closed condition. This causes reduced effective current and voltage to flow through the primary winding 522, driving the voltage across the secondary winding 526, and subsequently to the spark plug 110. The rapid switching of second switching element 514 is paced to provide a voltage V4, which ensures that the discharge through the spark gap will continue. At time Tf, the timing controller 102 sets switching elements 512, 514 to the an open condition, ending the ignition firing cycle.

The system for initiating and sustaining a spark may be used on any type of internal combustion engine requiring ignition of fuels with a spark plug. For example, the system may be used on engines for use on work machines, automobiles, trucks, or stationary engines, such as power generators. Additionally, the system may be used on engines for boats, planes, or other engines, for example. The system may be used to ignite all fuel types, and may be especially applicable to fuel types requiring a sustained arc to completely combust the fuel, such as, for example, some alternative fuels.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for firing a spark plug, comprising:

a timing controller configured to send a first timing signal and a second timing signal;

an ignition transformer having a primary winding and a secondary winding;

a spark-plug operably associated with the secondary winding of the ignition transformer;

a first switching element disposed between the timing controller and the primary winding of the ignition transformer, the first switching element adapted to control a supply of power to the primary winding based on the first timing signal; and a second switching element disposed between the timing controller and the primary winding of the ignition transformer, the second switching element adapted to control the supply of power to the primary winding based on the second timing signal.

2. The system of claim 1, wherein the primary winding includes a first and a second primary winding, the first primary winding being associated with the first switching element, and the second primary winding being associated with the second switching element.

3. The system of claim 1, further including:

a first voltage source configured to apply voltage across the ignition transformer when the first switching element is closed; and a second voltage source configured to apply voltage across the ignition transformer when the second switching element is closed.

4. The system of claim 3, wherein the first voltage source and the ignition transformer are configured to create an electrical pulse to initiate a spark at the spark plug, and wherein the second voltage source and the ignition transformer are configured to create an electrical pulse to sustain the spark.

5. The system of claim 4, wherein the first voltage source is a higher voltage source than the second voltage source.

6. The system of claim 3, wherein the first voltage source is a DC voltage source, and the second voltage source is one of an AC voltage source and a chopped DC voltage source.

7. The system of claim 1, further including:

a voltage source configured to apply a voltage across the ignition transformer when the first switching element is closed.

8. The system of claim 7, wherein the voltage source and the ignition transformer are configured to create an electrical pulse to initiate a spark at the spark plug when the first switching element is closed, and wherein the voltage source and the ignition transformer are configured to create an electrical pulse to sustain the spark when the second switching element is closed.

9. The system of claim 7, further including:

a current measurement device for providing current feedback to the timing controller.

10. A method for firing a spark plug, comprising:

operating a timing controller to generate a first timing signal and a second timing signal;

switching a first switching element in response to the first timing signal to apply a first voltage to a primary winding of an ignition transformer;

switching a second switching element in response to the second timing signal to apply a second voltage to the primary winding of the ignition transformer;

transforming the first voltage applied to the primary winding to a third voltage across a spark-plug to initiate a spark; and transforming the second voltage applied to the primary winding to a fourth voltage across the spark-plug to sustain the spark.

11. The method of claim 10, wherein the first voltage is greater than the second voltage.

12. The method of claim 10, wherein the first switching element is closed to apply the first voltage to the primary winding of the ignition transformer and wherein the second switching element is closed to apply the second voltage to the primary winding of the ignition transformer.

13. An engine control system, comprising:

an engine control module configured to generate an instruction signal;

a timing controller configured to receive the instruction signal, and provide a corresponding signal as a first timing signal and a second timing signal;

an ignition transformer having a primary winding and a secondary winding;

a voltage source configured to apply voltage across the ignition transformer when the first switching element is closed;

a spark-plug operably associated with the secondary winding of the ignition transformer;

a first switching element disposed between the timing controller and the primary winding of the ignition transformer, the first switching element adapted to control a supply of power to the primary winding based on the first timing signal; and a second switching element disposed between the timing controller and the primary winding of the ignition transformer, the second switching element adapted to control the supply of power to the primary winding based on the second timing signal.

14. The engine control system of claim 13, wherein the primary winding includes a first and a second primary winding, the first primary winding being associated with the first switching element, and the second primary winding being associated with the second switching element.

15. The engine control system of claim 13, further including:

a second voltage source configured to apply voltage across the ignition transformer when the second switching element is closed.

16. The engine control system of claim 15, wherein the first voltage source and the ignition transformer are configured to create an electrical pulse to initiate a spark at the spark plug, and wherein the second voltage source and the ignition transformer are configured to create an electrical pulse to sustain the spark.

17. The engine control system of claim 16, wherein the first voltage source is a higher voltage source than the second voltage source.

18. The engine control system of claim 15, wherein the first voltage source is a DC voltage source and the second voltage source is one of an AC power source and a chopped DC voltage source.

19. The engine control system of claim 13, further including:

a voltage source configured to apply voltage across the ignition transformer when the first switching element is closed.

20. The engine control system of claim 19, wherein the voltage source and the ignition transformer are configured to create an electrical pulse to initiate a spark at the spark plug when the first switching element is closed, and wherein the voltage source and the ignition transformer are configured to create an electrical pulse to sustain the spark when the second switching element is closed.

21. The engine control system of claim 19, further including:

a current measurement device for providing current feedback to the timing controller.

22. A method for firing a spark plug, comprising:

operating a timing controller to generate a first timing signal and a second timing signal, wherein one of the first timing signal and the second timing signal is an intermittent signal;

switching a first switching element in response to the first timing signal;

switching a second switching element in response to the second timing signal, wherein switching the first switching element and the second switching element applies an intermittent first voltage to a primary winding of an ignition transformer;

transforming the intermittent first voltage applied to the primary winding to a second voltage across a spark-plug to initiate and maintain a spark.

23. The method of claim 22, further including:

measuring a current to providing current feedback to the timing controller to control the intermittent signal.

* * * * *